United States Patent [19]

Greenberg

[11] Patent Number: 4,778,420

[45] Date of Patent: Oct. 18, 1988

[54] STRINGER CAP ASSEMBLY FOR MOUNTING INBOARD POWER BOAT ENGINE

[75] Inventor: Robert A. Greenberg, Melbourne, Fla.

[73] Assignee: Ray Industries, Inc., Knoxville, Tenn.

[21] Appl. No.: 47,261

[22] Filed: May 8, 1987

[51] Int. Cl.[4] ..... B63H 21/30

[52] U.S. Cl. ..... 440/111; 248/637

[58] Field of Search ..... 114/111, 112; 180/299, 180/300, 312; 248/637, 671, 674, 678

[56] References Cited

U.S. PATENT DOCUMENTS 3,112,016 11/1963 Peterson ..... 248/637

3,353,771 11/1967 Clem Te Bow ..... 248/637 X

FOREIGN PATENT DOCUMENTS 341567 1/1931 United Kingdom ..... 440/111

*Primary Examiner*—Sherman D. Basinger

*Attorney, Agent, or Firm*—William H. Drummond

[57] ABSTRACT

A stringer cap assembly for mounting a power boat engine includes an inverted L-shaped stringer cap, the top of which is shaped and dimensioned to lie along the top load-bearing surface of a stringer formed integrally in a power boat hull. A vertical stud is carried by and extends upwardly from the stringer cap to attach a motor mount. The cap assembly is through-bolted to the stringer.

1 Claim, 2 Drawing Sheets

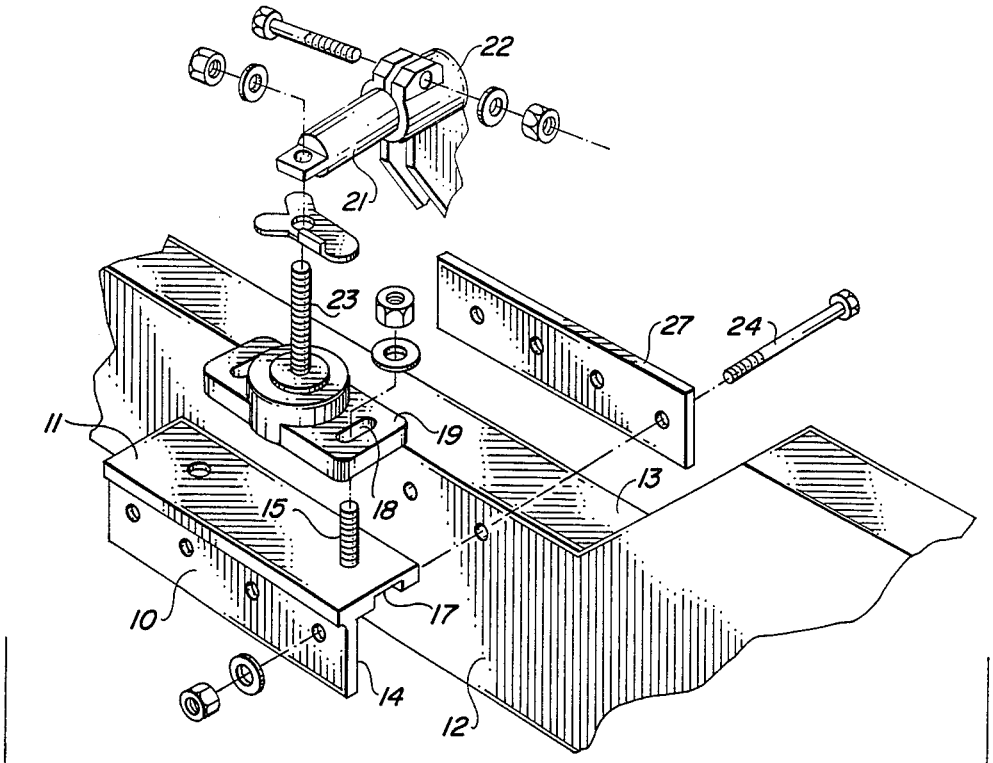
FIG. 1
FIG. 2
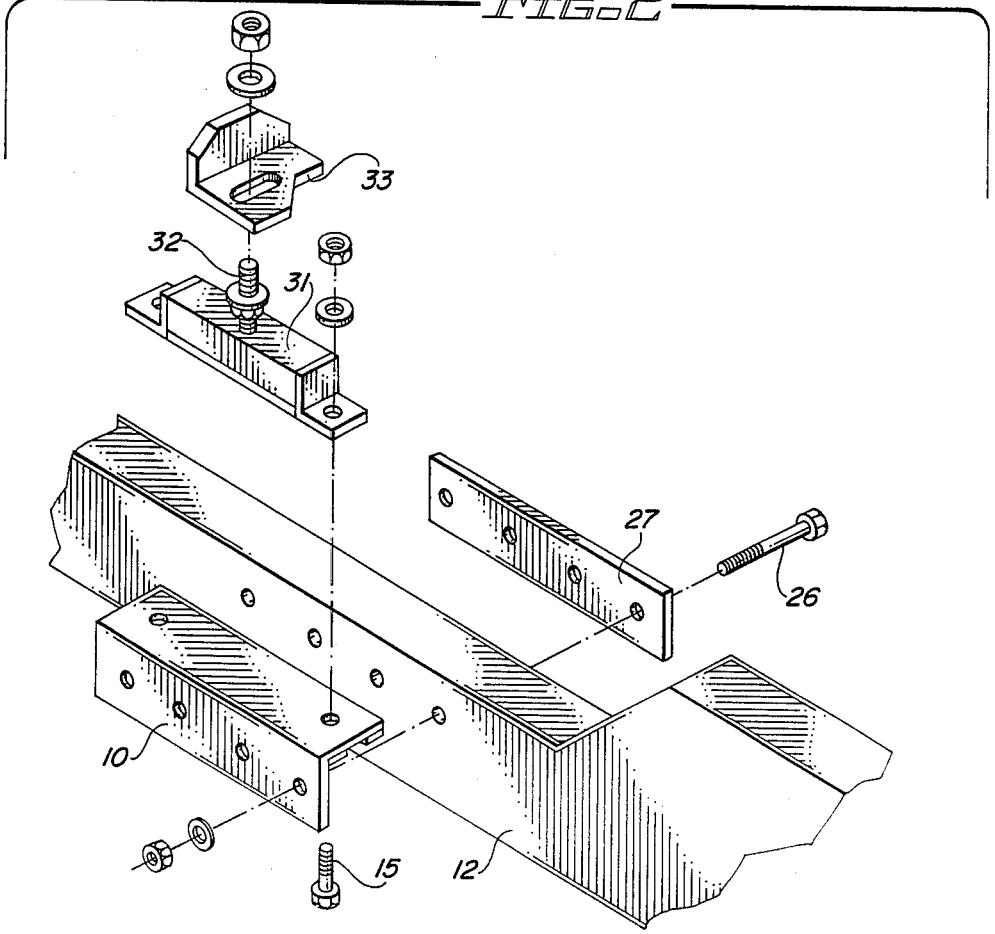

STRINGER CAP ASSEMBLY FOR MOUNTING INBOARD POWER BOAT ENGINE

This invention relates to improved apparatus for mounting an inboard engine in a power boat hull.

More particularly, the invention concerns an assembly (hereafter called "stringer cap assembly") which is adapted to secure a motor mount to a load-bearing stringer formed integrally in the boat hull to transfer the weight of the motor through the motor mount to the stringer.

Still more specifically, the invention concerns such a stringer cap assembly which provides for securing a power boat engine to its associated load-bearing stringers by through-bolting through the stringers rather than by lag screws as in the prior art.

Inboard power boat engines are conventionally mounted on upstanding, inverted U-shaped load-bearing stringers formed integrally in the power boat hull. The weight of the engine, transverse loads and tortional forces are transmitted through a "motor mount" which is conventionally attached to the stringers by means of lag screws which hold in the wood and/or fiberglass reinforced plastic laminates from which the hull and stringers are formed.

In use, the lag screws tend to loosen over time, allowing the motor mounts and the engine to be displaced from their proper operating positions, causing misalignment of the engine driveshaft and related problems.

It would be highly desirable, therefore, to provide means for mounting an inboard engine in a power boat hull in which the engine mounting assembly is attached to the load-bearing stringers by through-bolting rather than by lag screws.

Yet another object of the invention is to provide such means whereby the motor mounts are secured to the load-bearing stringers at their proper location more conveniently and which provides for fine adjustment of the position of the motor mounts with respect to the engine without drilling additional holes for lag screws and other mounting hardware.

Still another object of the invention is to provide such engine mounting means which are economically and ruggedly constructed, but in which close tolerances are not required.

These and other, further and more specific objects and advantages of the invention will be apparent to those skilled in the art from the following detailed description thereof, taken in conjunction with the drawings, in which:

FIG. 1 is an exploded perspective view of a stringer cap assembly constructed in accordance with the presently preferred embodiment of the invention;

FIG. 2 is an exploded perspective view, showing how the stringer cap of FIG. 1 is used to secure another conventional type of engine mount to such a load-bearing stringer;

Briefly, in accordance with the invention, I provide apparatus for mounting an inboard engine in a boat hull. Such hulls are typically formed of fiberglass-reinforced plastics which may include wooden elements to distribute the weight of other components carried by the hull, such as running gear, fuel tanks, etc. For the purpose of mounting engines in such hulls, the hulls normally include integrally formed transversely spaced longitudinal load-bearing stringers parallel to the longitudinal centerline of the hull. Inboard engines used with such hulls normally include mounting brackets formed integrally in or bolted to the engine casting which are provided on either side of the engine. In accordance with the invention, a stringer cap assembly is provided to secure a motor mount between each of the mounting brackets and a respective one of the load-bearing stringers. This assembly comprises an inverted L-shaped stringer cap, the top horizontal portion of which is shaped and dimensioned to contact the stringer along the top load-bearing surface thereof and the downwardly extending vertical portion of which is shaped and dimensioned to lie alongside the vertical side of the inverted U-shaped stringer. At least one vertical stud is carried by and extends upwardly from the stringer cap and is positioned to register with and extend through a corresponding aperture in the motor mount which is to be attached to the stringer at that point. Means are provided for through-bolting the stringer caps to the stringer.

In accordance with the presently preferred embodiment thereof, a backing plate is provided on the side of the stringer opposite the downwardly extending vertical portion of the stringer cap. The bolts for attaching the stringer cap and backing plate to the stringer extend through the stringer cap and backing plate.

Figure 3:
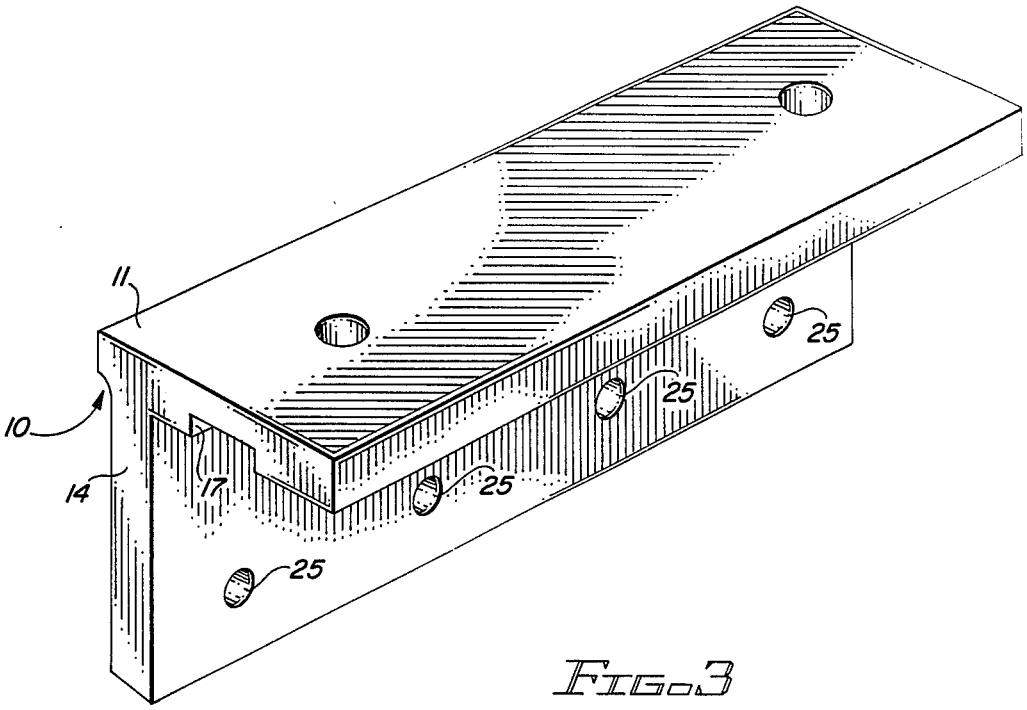
FIG. 3 is a perspective view of the stringer cap of FIGS. 1-2 with associated motor mount and engine parts omitted for clarity of illustration.
Figure 4:
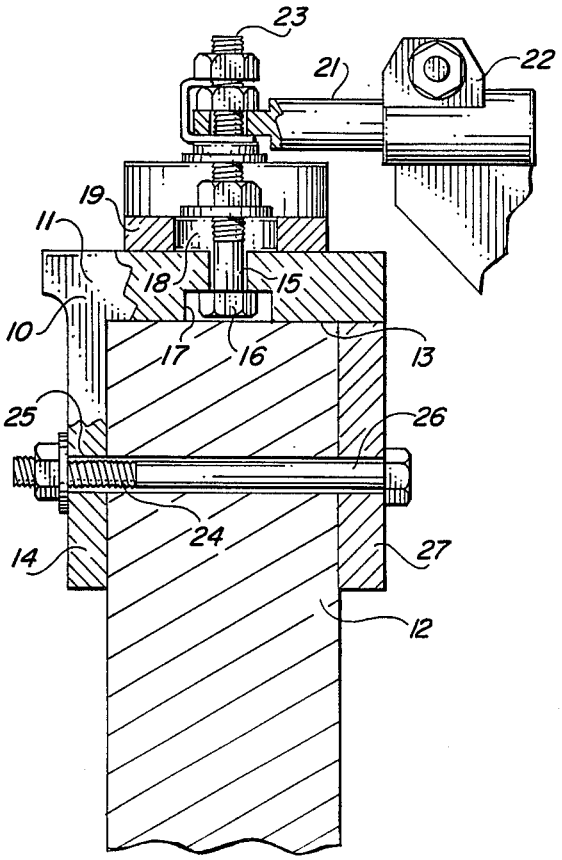
FIG. 4 is an assembly view of the components of FIG. 1.

Turning now to the drawings, in which the same reference characters identify like parts in the several views, FIGS. 1, 3 and 4 depict a stringer cap assembly consisting of an inverted L-shaped stringer cap 10,, the top horizontal portion 11 of which is shaped and dimensioned to contact the stringer 12 along the top load-bearing surface 13 thereof. The downwardly extending vertical portion 14 of the stringer cap 10 is shaped and dimensioned to lie alongside the stringer 12. Vertical studs 15, the heads 16 of which are received in a channel 17 formed in the underside of the horizontal portion 11, extend upwardly from the stringer cap 10 and are positioned to register with and extend through corresponding apertures 18 in a motor mount 19.

The motor mount 19 is, in turn, secured to the slide mounting bar 21 of a typical engine mounting bracket 22 by a threaded stud 23. Through-bolts 24 extend through apertures 25 and 26 formed, respectively, in the L-shaped cap 10 and the backing plate 27.

For purposes of further illustrating the invention, the stringer cap assembly of FIGS. 1 and 4 is shown in FIG. 2 in combination with another typical type of motor mount which is commonly used for securing engines in power boat hulls. As shown in FIG. 2, the stringer cap assembly consists of the inverted L-shaped cap 10, upwardly extending vertical stud 15 and, preferably, a backing plate 27 secured by through-bolts 24 to the stringer 12. This assembly is used to secure an engine mount 31 having an engine mounting stud 32 attached to an engine mounting bracket 33 formed integrally with the engine casting (not shown).

Having described my invention in such terms as to enable those skilled in the art to understand and practice it, and having identified the presently preferred embodiment thereof, I claim:

1. For mounting an inboard engine in a boat hull, said hull including transversely spaced inverted U-shaped longitudinal load-bearing stringers parallel to the longitudinal centerline of said hull, said engine including a mounting bracket assembly on either side of said engine, a stringer cap assembly for securing a motor mount between each of said mounting brackets and a respective one of said stringers, said assembly comprising:

(a) an inverted L-shaped stringer cap, the top horizontal portion of which is shaped and dimensioned to contact said stringer along the top load-bearing surface thereof and the downwardly extending vertical portion of which is shaped and dimensioned to lie alongside a vertical face of said stringer;

(b) at least one vertical stud carried by and extending upwardly from said stringer cap and positioned to register with and extend through a corresponding aperture in an associated mount;

(c) bolt means for through-bolting said stringer cap to said stringer, said bolt means extending through and terminating on each side of said stringer within the outer surface of said hull; and (d) transverse slot means in said mounting bracket assembly to receive a cooperating vertical stud, to permit adjustment of the transverse position of said engine in said hull and to secure said engine in said adjusted position.

* * * * *